United States Patent [19]

Tratz

[11] 4,205,632

[45] Jun. 3, 1980

[54] FEEDWATER PREHEATER WITH DEVICE FOR SEPARATING MOISTURE FROM MOISTURE-BEARING STEAM

[75] Inventor: Herbert Tratz, Ottensoos, Fed. Rep. of Germany

[73] Assignee: Kraftwerk Union Aktiengesellschaft, Mülheim an der Ruhr, Fed. Rep. of Germany

[21] Appl. No.: 903,591

[22] Filed: May 8, 1978

[30] Foreign Application Priority Data

May 9, 1977 [DE] Fed. Rep. of Germany ..... 2720812

[51] Int. Cl.[2] ..... F22B 1/06

[52] U.S. Cl. ..... 122/34; 122/441; 122/483; 165/114

[58] Field of Search ..... 122/32, 34, 441, 483; 165/113, 114

[56] References Cited

U.S. PATENT DOCUMENTS

| | | | |
|---|---|---|---|
| 3,795,273 | 3/1974 | Brigida et al. | 165/114 |
| 3,923,010 | 12/1975 | Chlique | 122/483 |
| 3,938,588 | 2/1976 | Coit et al. | 122/441 |

*Primary Examiner*—Edward G. Favors

*Attorney, Agent, or Firm*—Herbert L. Lerner

[57] ABSTRACT

Feedwater preheater having a multiplicity of tubes conducting feedwater, in combination with a device for separating moisture from moisture-bearing steam, includes structural components disposed transversely to a steam flow toward the heating tubes in vicinity of a steam inlet to the preheater, the structural components being in the form of a plurality of rod-shaped rows of profile members disposed between respective tubes of the feedwater preheater and the steam inlet, adjacent rods of the rows of profile members being spaced from one another, the spaces therebetween being mutually offset from one row of profile members to another in direction toward the tubes of the feedwater preheater.

6 Claims, 2 Drawing Figures

Figure 1:
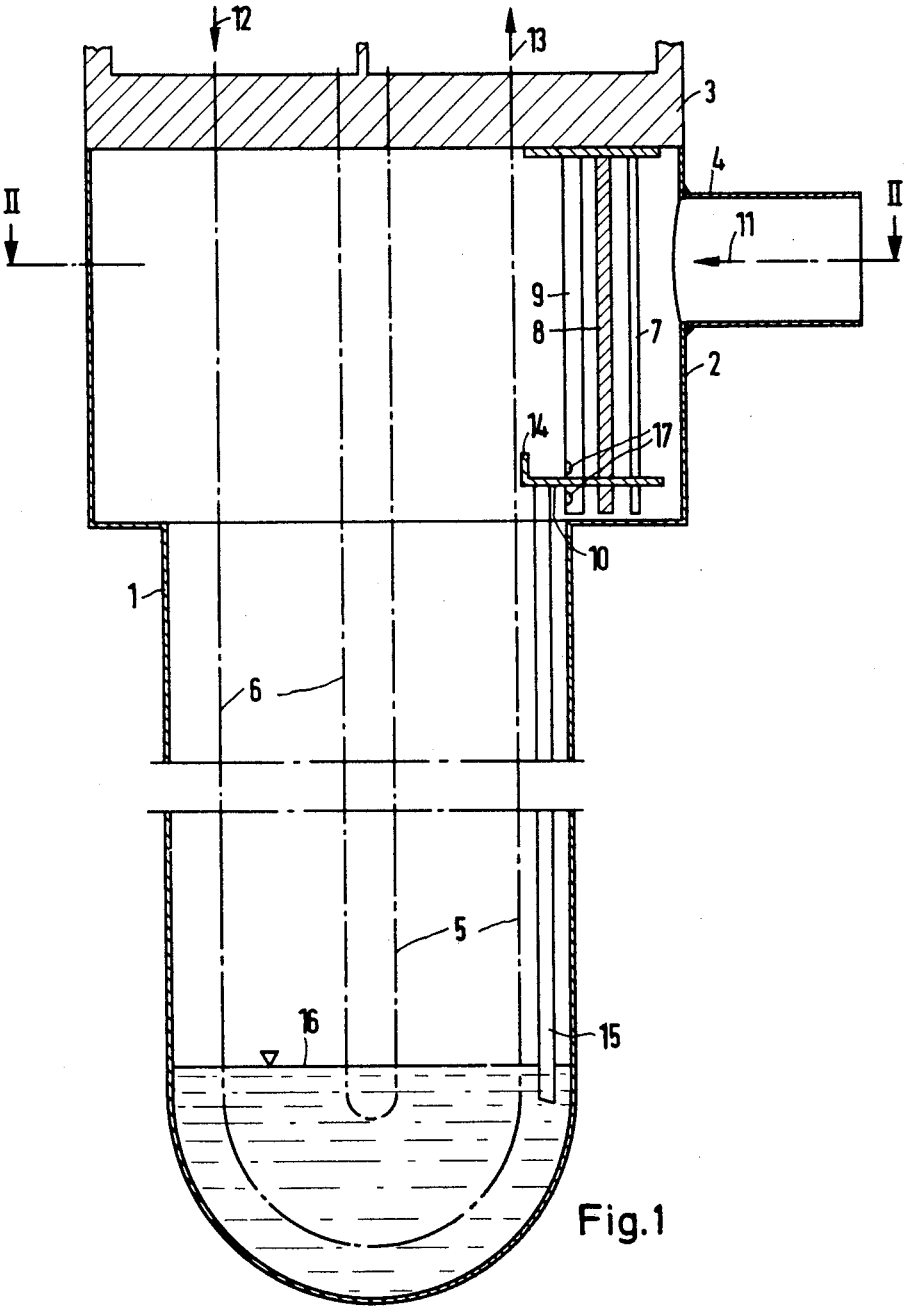

FEEDWATER PREHEATER WITH DEVICE FOR SEPARATING MOISTURE FROM MOISTURE-BEARING STEAM

The invention relates to a feedwater preheater with steam moisture separator or device for separating moisture from moisture-bearing steam, wherein structural components extending transversely to the steam flow are provided in vicinity of the steam inlet.

It has become known heretofore to protect heat-exchanging tubes of feedwater preheaters by means of baffle plates against erosion by water droplets entrained in superheated steam (e.g. VGB-Kraftwerkstechnik 53, No. 1, January 1973, page 4, FIG. 11). In this regard, water droplets can be swept into the steam flow in vicinity of the edge of the baffle plate and cause erosion. A result thereof is that, at the baffle plates, the small, relatively harmless water droplets combine to form larger droplets, which are then entrained by the steam flow from the edge of the baffle plate. At this location, the velocity of the steam flow is often especially high, because the superheated steam flows towards all the heater tubes of the feedwater preheater and, thus, also towards those tubes which are located behind the baffle plate and cannot be acted upon directly by the steam. A high-velocity steam flow is consequently formed at the edge of the baffle plate. This flow is deflected, at least in part, in direction toward the tubes located behind the baffle plate and, indeed, at the very instant it is deflected, strips or separates the large water droplets from the edge of the baffle plate. These water droplets, because of the relatively larger mass thereof, can only partly follow the steam flow, and consequently strike the preheater tubes with considerable velocity and may destroy them. If the water content of the steam is high, a partial flow of water is stripped away from the baffle plate beforehand in front or upstream of the baffle plate edge and is flung at high velocity against the jacket or casing of the feedwater preheater, so that erosion may also occur.

Another device for separating steam moisture in a horizontal feedwater preheater has become known heretofore (VGB Kraftwerkstechnik 56, No. 8, August 1976, page 495, FIG. 16), wherein water droplets are caught by inclined strips or ledges at the wall of a steam chest and collected in the flow shade or shadow and discharged, so that the steam in the center of the flow contains virtually only steam moisture in the form of small droplets of water.

It is an object of the invention to provide a feedwater preheater with a steam moisture separator wherein the velocity of large water droplets is reduced and the droplets are comminuted, so that no large water droplets having a high velocity are able to reach the heating tube bundle with the steam flow.

With the foregoing and other objects in view, there is provided, in accordance with the invention, a feedwater preheater having a multiplicity of tubes conducting feedwater, in combination with a device for separating moisture from moisture-bearing steam, comprising structural components disposed transversely to a steam flow toward the heating tubes in vicinity of a steam inlet to the preheater, the structural components being in the form of a plurality of rod-shaped rows of profile members disposed between respective tubes of the feedwater preheater and the steam inlet, adjacent rods of the rows of profile members being spaced from one another, the spaces therebetween being mutually offset from one row of profile members to another in direction toward the tubes of the feedwater preheater.

What is achieved by these measures is that the dynamic pressure of the superheated steam cannot act directly upon the tube system, and very large entrained droplets impinge upon the profile members and are broken up into a multiplicity of smaller droplets. Due to the spaces or gaps, which are offset from one another between the profile members, the quantity of steam is limited and the flow velocity thereof is reduced, so that as much steam flows through the steam moisture separator, ultimately, as is condensed in the rearward or farther downstream part of the tube system. In order to amplify this effect, it is especially advantageous, in accordance with another feature of the invention, to provide the spaces or gaps between adjacent rods of the rows or profile members with a width that decreases from one row of profile members to another row thereof in direction toward the tubes of the feedwater preheater.

By deflecting the steam flow within the individual rows of profile members, the steam moisture is largely precipitated or condensed. The water droplets are collected in the flow shade or shadow and run downwardly due to gravity, the local steam velocity no longer being sufficiently large to entrain these droplets anew or to accelerate them to a velocity which can cause erosion of the heater tube bundle.

In order to achieve adequate protection of the tubes of the tube bundle, in accordance with a further feature of the invention, an outlet chamber is provided, and the tubes in vicinity of the steam inlet conduct feedwater to the outlet chamber, the rows of profile members semicircularly surrounding the tubes through which the feedwater flows upwardly toward the outlet chamber. Only little steam is condensed there. Thus, a correspondingly low steam velocity for the water separation becomes set or established there in the spaces or gaps between the rows of profile members.

In accordance with an added feature of the invention, the rows of profile members are formed of tubes or also of round stock of suitable dimensions, which can consist of water-resistant material.

If tubes are used, in accordance with an additional feature of the invention, they are formed with lateral openings for withdrawing the steam moisture within the tubes.

In accordance with a concomitant feature of the invention, the feedwater preheater has a given water level, and a mounting plate is disposed above the given water level and formed with a flange ring for collecting moisture separated from the moisture-bearing steam, and a water run-off tube extends downwardly to below the water level of the feedwater preheater for discharging into the water the moisture collected on the flange ring.

Other features which are considered as characteristic for the invention are set forth in the appended claims.

Although the invention is illustrated and described herein as embodied in a feedwater preheater with device for separating moisture from moisture-bearing steam, it is nevertheless not intended to be limited to the details shown, since various modifications and structural changes may be made therein without departing from the spirit of the invention and within the scope and range of equivalents of the claims.

Figure 2:
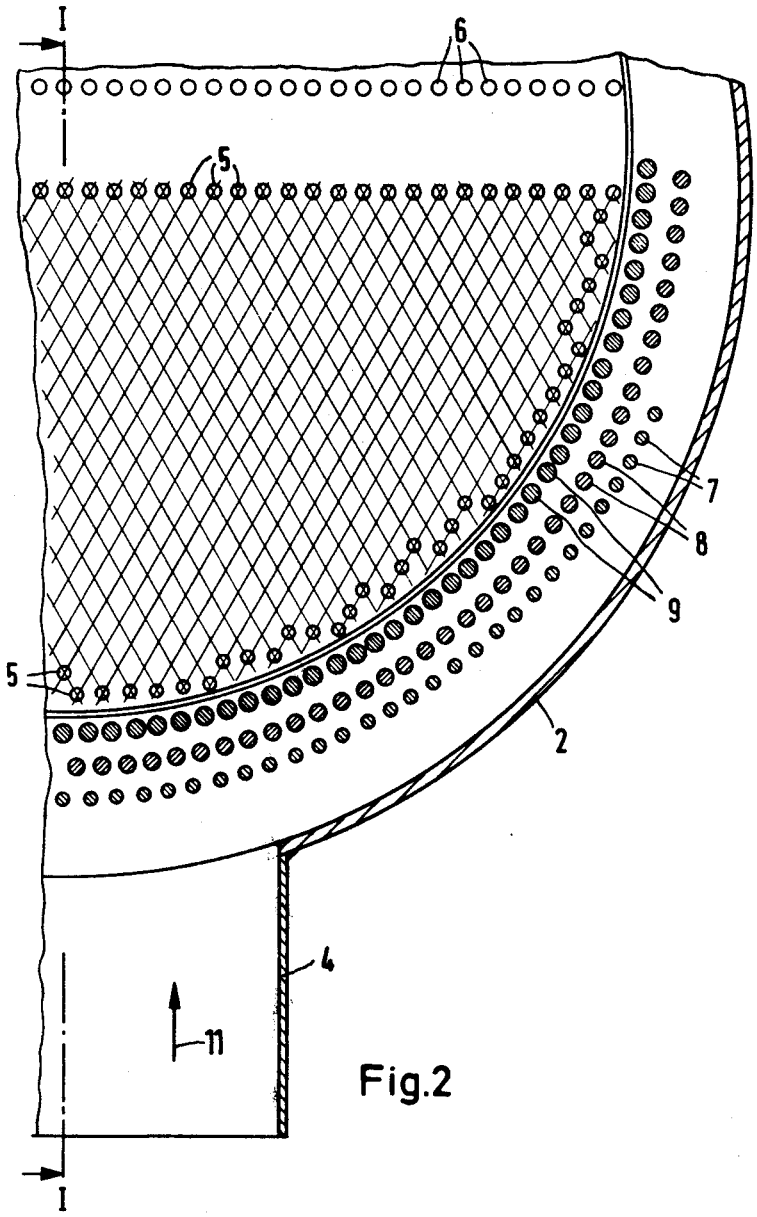

The construction and method of operation of the invention, however, together with additional objects and advantages thereof will be best understood from the following description of specific embodiments when read in connection with the accompanying drawings, in which:

FIG. 1 is a diamgrammatic longitudinal sectional view of a feedwater preheater constructed in accordance with the invention; and FIG. 2 is an enlarged fragmentary cross-sectional view of FIG. 1 taken along the line II—II in direction of the arrows and showing the feedwater preheater in vicinity of the steam inlet.

Referring now to the figures of the drawing, there is shown therein a steam jacket or casing 1, which surrounds tubes 5 and 6 of a tube bundle. The steam jacket 1 is enlarged or widened in the upper region 2 thereof for admitting the steam flow. The widened jacket portion 2 is disposed adjacent a tube sheet or plate 3 and has a steam inlet nozzle 4 connected thereto. Rows of prismatic profile members 7, 8 and 9, disposed behind one another in radial direction and mutually offset, as shown in FIG. 2, surround the tubes 5 and 6 of the tube system from which the feedwater leaves in the direction of the arrow 13, after having entered the tubes 5 and 6 of the tube system in direction of the arrow 12.

The profile iron 7 and 8 of the steam moisture separator are of such dimensions that the gaps or spaces between the rows of the profile iron 7 are larger than those between the rows of the profile iron 9. The steam flowing into the feedwater preheater in direction of the arrow 11 therefore encounters ever narrower gaps between the rows of profile steel along the path thereof to the tubes 5. The rows of profile iron 7, 8 and 9 are fastened at the lower end thereof in a holding plate 10 which has a flange 14 and a discharge tube 15 extending therefrom, the latter ending below the water level 16 in the preheater. In the rods of the row of profile iron 9, which may be constructed as tubes, openings 17 are provided for introducing the steam moisture.

There are claimed:

1. Feedwater preheater having a multiplicity of heating tubes conducting feedwater, in combination with a device for separating moisture from moisture-bearing steam, comprising a steam inlet formed on the preheater, means for conducting a flow of steam through the steam inlet toward the heating tubes of the preheater, structural components disposed transversely to the steam flow toward the heating tubes in vicinity of the steam inlet to the preheater, said structural components being in the form of a plurality of rows of rod-shaped profile members disposed between respective tubes of the feedwater preheater and the steam inlet, adjacent rods of the rows of profile members being spaced from one another, the spaces between the rods of each of rows of profile members being offset from the spaces between the rods of the respective row of profile members located adjacent thereto from row to row of the profile members in direction toward the tubes of the feedwater preheater.

2. Feedwater preheater according to claim 1, wherein the width of said spaces between adjacent rods of said rows of profile members decreases from one row of profile members to another row thereof in direction toward the tubes of the feedwater preheater.

3. Feedwater preheater according to claim 1, including an outlet chamber, and wherein the tubes in vicinity of said steam inlet are for conducting feedwater to said outlet chamber, and wherein said rows of profile members semicircularly surround the tubes through which the feedwater flows toward said outlet chamber.

4. Feedwater preheater according to claim 1, wherein said rows of profile members are formed of round stock.

5. Feedwater preheater according to claim 1, wherein said rows of profile members are formed of tubes having lateral openings formed therein for withdrawing steam moisture.

6. Feedwater preheater according to claim 1 having a given water level, and including a mounting plate disposed above the given water level and formed with a flange ring for collecting moisture separated from the moisture-bearing steam, and a water run-off tube extending downwardly to below the water level of the feedwater preheater for discharging into the water the moisture collected on said flange ring.

* * * * *